US008177618B1

(12) United States Patent
Brennan

(10) Patent No.: US 8,177,618 B1
(45) Date of Patent: May 15, 2012

(54) APPARATUS IN SUPPORT OF A WAGERING CARD GAME AND METHOD OF PLAY

(76) Inventor: Craig Brennan, San Clemente, CA (US)

( * ) Notice: Subject to any disclaimer, the term of this patent is extended or adjusted under 35 U.S.C. 154(b) by 571 days.

(21) Appl. No.: 12/454,968

(22) Filed: May 26, 2009

(51) Int. Cl.
*A63F 9/24* (2006.01)

(52) U.S. Cl. ..... 463/13; 463/11; 463/16

(58) Field of Classification Search ..... 463/11–13, 463/16, 25

See application file for complete search history.

(56) References Cited

U.S. PATENT DOCUMENTS

| | | | | |
|---|---|---|---|---|
| 6,733,390 | B2 | 5/2004 | Walker et al. | |
| 7,029,011 | B2 | 4/2006 | Strong et al. | |
| 7,056,208 | B2 | 6/2006 | Cogert | |
| 2003/0064807 | A1 | 4/2003 | Walker et al. | |
| 2007/0126181 | A1 | 6/2007 | Ciaffone | |
| 2007/0210519 | A1 * | 9/2007 | Barlev | 273/292 |
| 2008/0012222 | A1 | 1/2008 | Starzec | |
| 2008/0064467 | A1 | 3/2008 | Reiner | |
| 2008/0088087 | A1 | 4/2008 | Weitzman et al. | |
| 2008/0102916 | A1 | 5/2008 | Kovacs et al. | |
| 2008/0108401 | A1 | 5/2008 | Baerlocher et al. | |
| 2008/0108412 | A1 | 5/2008 | Snow et al. | |
| 2008/0113765 | A1 | 5/2008 | DeWaal | |
| 2008/0237985 | A1 | 10/2008 | Cogert et al. | |
| 2010/0216532 | A1 * | 8/2010 | Halverson | 463/11 |

* cited by examiner

*Primary Examiner* — Bradley K Smith
(74) *Attorney, Agent, or Firm* — Patent Law & Venture Group; Gene Scott

(57) ABSTRACT

The present invention provides a system and method for playing wagering card games. The method provides for distribution of a pot based on a calculated value of the cards (equity) held by game's players so that the pot is distributed more equitably then is the case with a winner-take-all rule. In one embodiment of the method, the use of equity in card hands is optional so that some of the hands remaining at the end of a game receive payouts based on equity while all other hands receive no payout except the best hand.

16 Claims, 5 Drawing Sheets

APPARATUS IN SUPPORT OF A WAGERING CARD GAME AND METHOD OF PLAY

FIELD OF THE PRESENT DISCLOSURE

This disclosure relates generally to wagering card games and particularly to such a game wherein players realize the benefit of a more equitable pot distribution based on the strength of their hands when no more betting is possible and there are more cards to come.

DESCRIPTION OF RELATED ART INCLUDING INFORMATION DISCLOSED UNDER 37 CFR 1.97 And 1.98

Poker games, especially those using the Internet, are becoming very popular. Most poker games have multiple players competing against each other for a "pot" using a best hand wins rule. In such games the house (the hosting site) collects a fee, known as a "rake", from the pot accumulated during each hand. Two popular multi-player poker games are known as Texas Hold'em and Omaha. In these games there are several players; typically limited to some maximum number, such as nine or ten, who are positioned around a gaming table.

According to a prior-art implementation of such a game the respective players play each against the other and bet according to respective "private" cards, known as "hole" cards, that each player is dealt and which only that player can see. The first player to the left of the dealer button must place a bet known as the small blind, and the second player to the left of the dealer button must place a larger bet known as the big blind. Each respective player is dealt two hole cards in the Texas Hold'em game and four hole cards in the Omaha game prior to a betting round known as the "pre-flop" round. Betting proceeds to the left, starting from the player to the left of the big blind. If there are fewer than a pre-determined number of players at the table, only a single blind bet may be required. Players must at least call these bets to remain in the hand. A player who does not call these bets is said to have folded and is no longer engaged with the hand.

After this pre-flop betting round the players bet according to additional, open, cards which are common to all the players and called "community" cards, with a total of five community cards being dealt in further rounds known as the flop, the turn and the river. These stages are each accompanied by further betting. The object of the game is for each respective player to combine five cards from among the cards dealt to that player, two hole cards plus five community cards, for a total of seven cards, in the case of Texas Hold'em, or four hole cards plus five community cards, for a total of nine cards, in the case of Omaha. Each player composes the highest-ranking poker hand possible from these cards. In betting rounds after the pre-flop round players have the option to "check" if there have not yet been any bets during that round. A player who has checked remains in the hand without further betting. If no other player bets during that round, i.e., all other players remaining in that hand also check, play proceeds to the drawing of one or more community cards for the next round, or, in the case of the river, to the showdown, wherein the hole cards are displayed and the winner determined accordingly. If there is any betting in a round, then all players who checked must call those bets in order to remain in the hand. Players may also raise a bet and others must see their raise or fold, or raise again, and so on.

According to traditional play rules, when one or more players has bet "all-in", as described below, and no more than one active player has money at the table, the remaining cards are dealt with no further betting, a player wins the whole pot if that player has the highest-ranking five-card poker hand among those players remaining. If, during a round of betting, a player is unable to call a bet because that player does not have sufficient money at the table or chooses to bet everything he has at the table, the player can elect to go all-in, meaning that the player bets the remainder of the money that player has at the table and can only win according to the amount that player has bet. For example, if there are two players remaining in a hand, and $150 had accumulated in the pot before a new community card is dealt, and a first player has bet $50 after the dealing of the new community card, a second player having only $20 remaining at the table can go all-in by betting the $20. The remaining cards are dealt with no further betting. If, at the showdown, the second player has the best hand then the second player receives $190, less the rake. From this, it can be seen that no more skill was involved from the point of the all-in and usually only one player can realize a portion of the pot during each game.

Therefore, there is a need for an improvement in the wagering and payout systems in traditional card games having multiple rounds of betting such as described above, where such improvements tend to reduce or eliminate the "luck" factor. In the present invention method, a player can be assured that at a point in the game where no more betting is possible, i.e., no more skill is applicable that an equitable payout is assured to the player.

Strong, et al, U.S. Pat. No. 7,029,011 teaches the distribution of wagers to the remaining river player holding the best hand in accordance with standard poker ranking, but also suggests a bonus pay awarded to each of the remaining river players in accordance with a scale, and finally, a jack pot awarded to all remaining river players if two or more of the remaining players have declared hands that are equal to, or exceed, a selected poker rank.

Of interest in the prior art, also, is Reiner, US 2008/0064467 which teaches calculating an expected value of a card hand at the time the card hand folds, and, a payout to the corresponding player based on that expected value even though the player has folded. Also of interest is Barley, US 2007/0210519 which teaches the distribution to a player who wagered during an early round of play, whether or not the player wages during a later round of play. The wagering method of the present invention distinguishes over Reiner and Barley by implementing a pot distribution method when no further betting is possible and there are more cards to come based on player election of an equity play version of common wagering card games, wherein some players may elect and others may not, or wherein the election is based on a set of conditions or formula. The present disclosure therefore distinguishes over the prior art providing heretofore unknown advantages as described in the following summary.

BRIEF SUMMARY OF THE INVENTION

The present invention teaches an improvement in wagering card games as compared to the winner-take-all method of disbursing the pot. In the present invention, a card game is played by players who may elect pot distribution to the remaining players based on a calculated equity of a hand which is made up of a player's hole cards plus selected community cards. A computer operates to provide game feature presentations, tracks locations of cards, calculates equity positions of the card hands and declares winners and pot distributions. Therefore, the game may be played with all players present at a casino card table or with all players communicating with a game controlling computer over the Internet. The method uses standard game rules but distinguishes by distributing the pot in accordance with the equity realized by player's cards.

A primary objective inherent in the above described apparatus and method of use is to provide advantages not taught by the prior art.

It is an object of the present invention to provide a computer controlled wagering card game having plural rounds of wagering and a payout based, at least partly, on equity calculations of card hands.

It is a further object to provide such an invention whereby equity play is optional to the players as a group.

It is a further object to provide such an invention whereby equity play is optional to each of the players individually.

It is a further object to provide such an invention whereby equity play may be initiated and withdrawn at any time, or alternately at certain times, and as frequently as a player wishes, or at a restricted number of times.

It is a further object to provide such an invention whereby equity play is established or not based on a player's current equity.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described invention and its method of use in several preferred embodiments, which are further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1A:
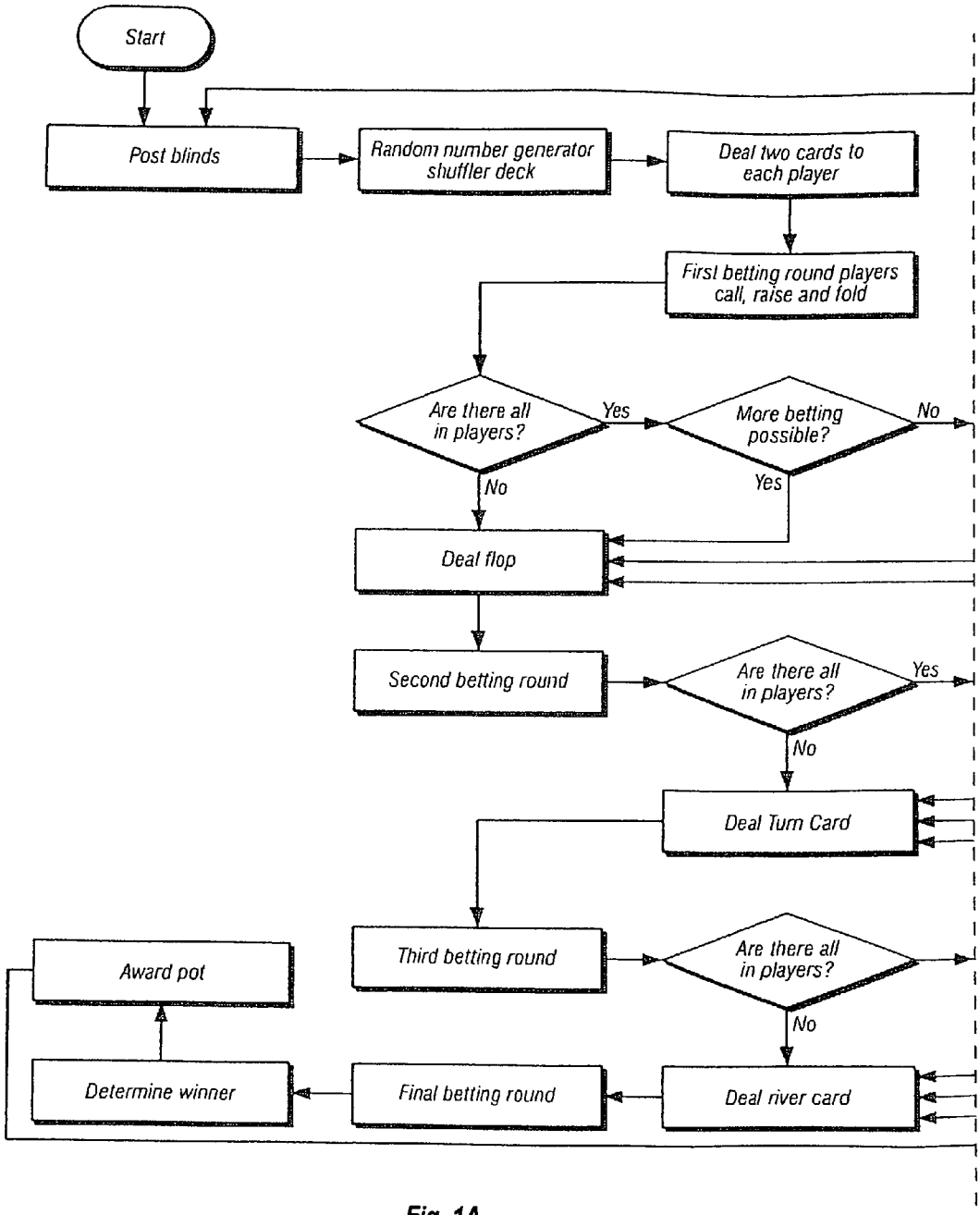
FIGS. 1A and 1B are a logic diagram of the present invention as used in a Texas Hold'em card game.
Figure 1B:
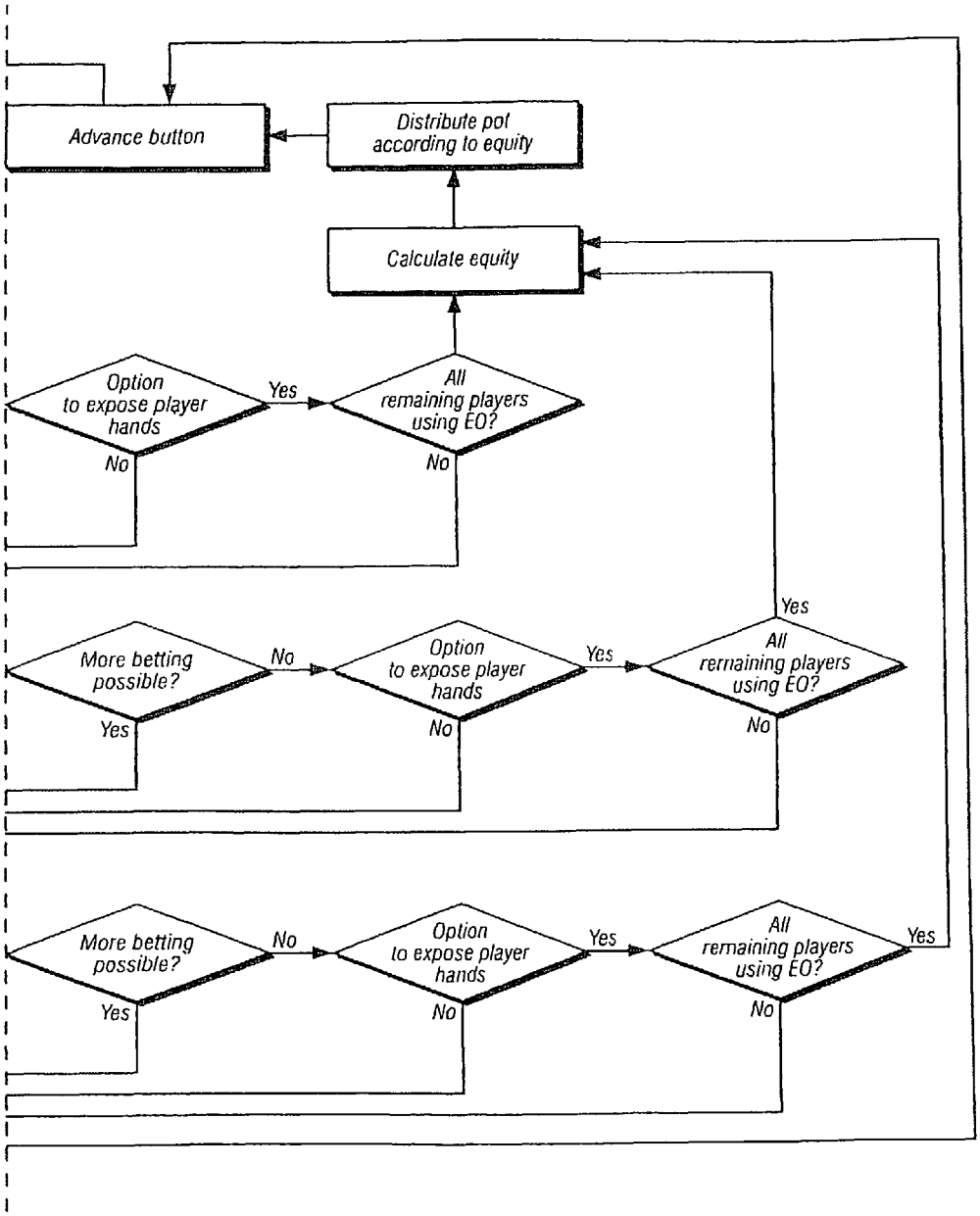

The principals of the present invention can be applied to the well known card games Texas Hold'em, Omaha, Pot Limit Omaha and other wagering card games. In FIGS. 1A and 1B is shown a logic diagram defining the method of the invention as applied to Texas Hold'em, but this is for example only, so that the principals defined therein should not be considered as limiting the present method to any particular card games. In this diagram the term EO appears and stands for "equity option" and also for "equity play" as used in this specification, and these two terms are used interchangably.

Figure 2:
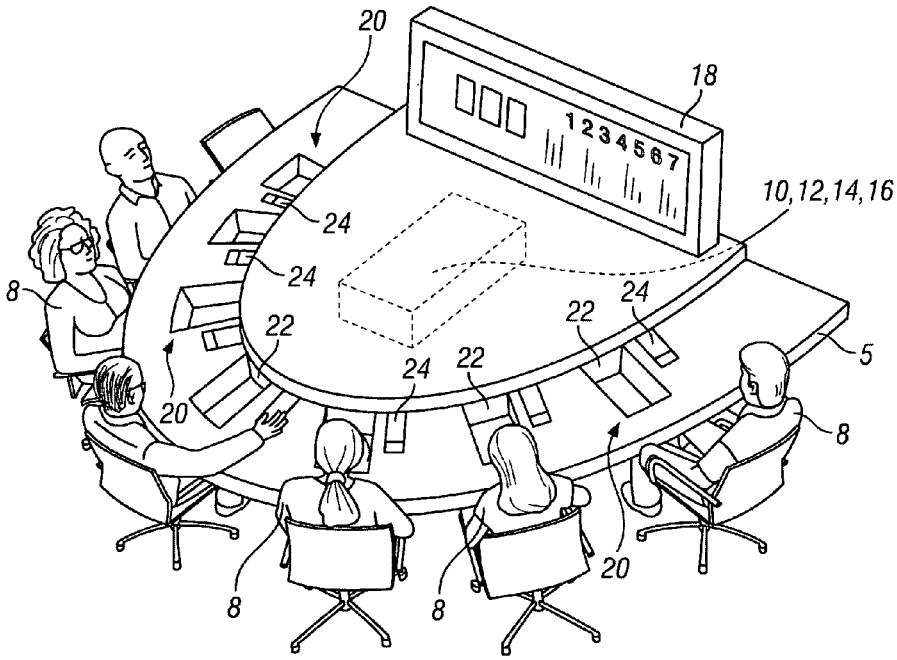
FIG. 2 is a perspective view of an automated game embodiment of the present invention as played in a casino.

The apparatus of the present invention, as shown in one embodiment in FIG. 2, includes a computer system 10 comprised of a data processor 12, a memory device 14, a software instruction set 16, and a display, referred to herein as the central display 18. The apparatus further includes a plurality of player modules 20. The player modules 20 are in data communication with the computer system 10. In one embodiment (FIG. 2) of the present invention, the computer system 10 is located in a gambling casino and its central display 18 and the player modules 20 are incorporated in a gambling table 5 about which players 8 preferably sit. Physical playing cards are not used, but rather electronic images of the playing cards are displayed on the central display 18 and on module displays 22 of the player modules 20. The module displays 22 are built into the gambling table 5 or otherwise situated and shielded so that players 8 cannot see each others cards displayed on module displays 22. Betting is accomplished by the players via electronic keypads 24 on their modules 20, and the pot, as well as the chips of each of the players is displayed on the display 18 for all of the players to see at all times. It is noted that the terms "playing card," "playing cards," "card," and "cards" as used herein shall refer to actual physical playing cards as are well known in the field, and shall also refer to images of playing cards as appear on displays 18 and 22.

Figure 3:
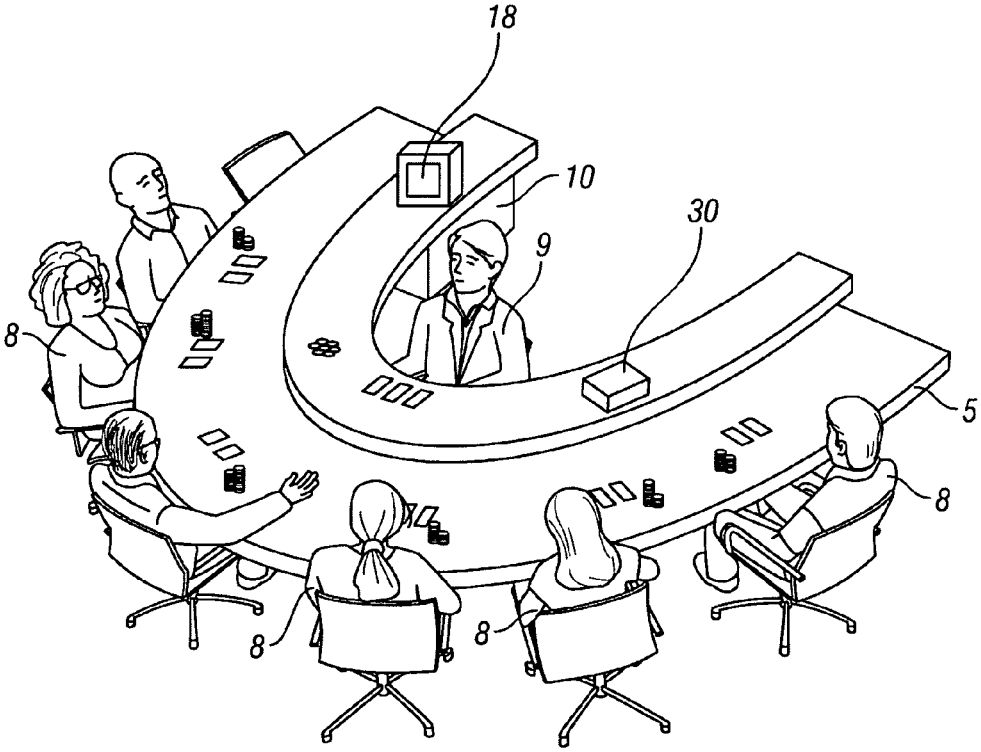
FIG. 3 is a perspective view of dealer managed game embodiment of the present invention as played in a casino.

In another embodiment of the present invention, as shown in FIG. 3, the computer system 10 is used, as above, and the central display 18 is located at the gambling table 5. A casino dealer 9 manages game play, and he or she deals actual playing cards to the players as shown in the figure. A playing card dispenser 30 is used and networked with the computer system 10, wherein as each card is dispensed to the dealer for him to deal onto the table 5, the card's identity is read electronically by a scanning device within the dispenser 30 and is stored in the memory device 14 of the computer system 10. Betting is accomplished using casino chips placed on the table, and each player is able to "peek" at his/her hole cards as is well known.

Figure 4:
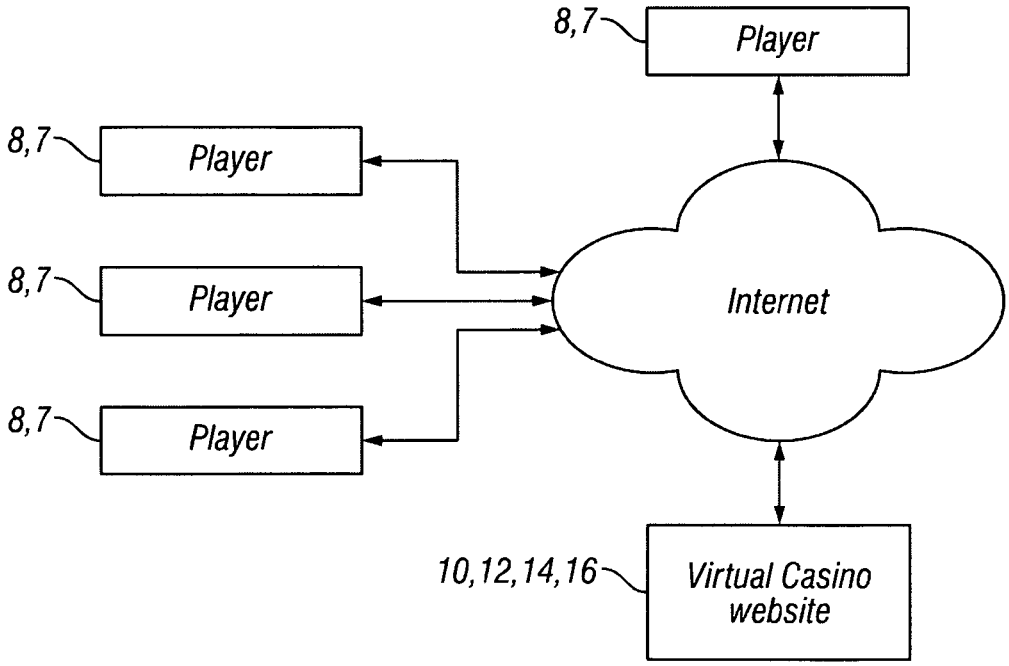
FIG. 4 is a concept diagram showing a networked game embodiment where players communicate with a virtual casino web site via the Internet.

In still another embodiment of the present invention, as shown in FIG. 4, the computer system 10 is located at a virtual on-line casino, which is in data communication with Internet connected computers 7 of distant players 8. The players 8 cannot see each others private cards, but all players can see the community cards, the pot, and the chips of all the players 8 on monitors of their individual computer systems 7. Betting is accomplished by each player 8 using an input device part of computer 7, such as a keyboard and/or mouse. In this embodiment, at least one of the players 8 is a person, but other players 8 may be persons or virtual persons as generated by the computer system 10. Playing against virtual persons or imaginary characters in gaming is extremely well known in the art.

In all three of the above described physical configurations as well as other configurations that might be envisioned, the method of the present invention is carried out in a same manner embodying the principals of the invention as will be described below.

An important distinction between the standard rules of play for a wagering card game such as Texas Hold'em, and the same or similar game in accordance with the present method, lies in the ability of the players 8 to elect an "equity option," whereupon play for the electing player 8 will be referred to as "equity play" throughout this description. Where, in standard or traditional play, if a point is reached where no further betting is possible, as for instance at least one of the players 8 is all-in, and there are more cards to be dealt, the remaining cards are dealt and the winner of that hand takes the entire pot and the losers lose their wagers. However, under equity play, if a point is reached where no further betting is possible and there are more cards to be dealt, no further cards are dealt and the remaining active players 8 split the pot according to their equity. Equity is referred to throughout this description and the claims that follow as the equity calculated in accordance with each players hand.

In this description and the claims to follow, the term "hand" or "card hand" refers to the cards held by a player, some of which may be held physically in the hand of the player, or merely displayed on the player's display module, and some of which may be displayed face up on the card table, or displayed on the central display 18 or both. The term "player" shall refer to a person who is included with those who are playing the card game. The term "equity" is used herein to mean the strength of the player's hand. Now the equity in a hand may be calculated in many ways and the method and basis of such calculation is not considered critical to the carrying out of the present invention method. One way to determine the equity of a given hand is by the well regarded and well known and straightforward statistical calculation of the chance of that hand going on to be a winner, assuming that all of the hands that are in the game at that point will remain in the game until the end. This type of calculation is extremely well known and may be conducted at various Internet sites that offer the service such as www.twodimes.net. For example if a first player 8 has As Ac and a second player has Ks Kc and assume both are all-in at the pre-flop round, the equity is calculated by summing up the results of all the possible five card combinations that can be dealt. There are 48 cards remaining in the deck of which there are 1,712,304 five-card combinations. Of those it is calculable that the aces will win 1,410,336 times and the kings will win 292,660 times, and they will tie 9,308 times. This results in an equity of 0.826 and 0.174 respectively. Other ways of determining the equity of hands are possible such as a system wherein points are assigned to various cards, suites and combinations.

The game proceeds using standard game rules. When no more betting is possible and more cards may be dealt, a requirement for initiating equity play pot distribution, the pot is distributed to the remaining players 8, that is, those that have not folded, based on the equity of the cards held in their hands.

In a further embodiment, prior to the start of play, let us say, some players 8 chose equity play, while others do not. When no more betting is possible, if the remaining players 8 had all chosen equity play, the pot is distributed as in the preceding paragraph. However, if the remaining players 8 include those that did, as well as those that did not choose equity play, the pot is distributed according to standard winner-take-all rules.

In still another embodiment, the players each are able to elect, or cancel the equity option at any time before play has started and even during game play. A limit may be set as to the number of reversals between playing the equity option and not. When no more betting is possible, no further changes in equity option election is possible. The pot is distributed as in the preceding paragraph.

In still another embodiment, prior to the start of play, election of the equity option may be made along with a condition under which the equity option is, or is not placed into play for each player individually. For example, a player 8 may choose to use the equity option: always, never, when their equity is greater than that of all of the other players 8, when equity is greater than the average equity at the table and so on. When no more betting is possible the pot is distributed as in the previous paragraph. It should be noted that this embodiment is not able to be carried out manually.

In yet another embodiment, the game begins under standard rules of play. When no more betting is possible, but not all of the cards have been dealt, the remaining players expose their hole cards and then decide if they want to use the equity option. If they decide unanimously to use the equity option the pot is awarded based on their current equity. If a player decides not to use the equity option, the remaining cards are dealt and the pot is distributed to the best hand.

In the above embodiments of the method of play in the present invention, the community cards are shown to all of the players either on the central display 18 or on the gambling table, or both as shown in the figures. Each player is able to view his/her hole cards on a module display 22 or on the gambling table face down. Each player is able to see the chips of all of the other players either as shown on the module display 22 or as stacked on the gambling table in plain sight. The equity in each hand that is in play is calculated by the data processor 12 continuously, which is possible since the identity of all cards in play, both hole and community, are stored in the memory device 14. The software instruction set 16 uses card and full hand values in accordance with a protocol such as previously described, and uses a display routine for placing information on the several display devices in accordance with common and well-known software routines.

EXAMPLE 1

An online poker site operates an embodiment of the present invention calling it "No Limit Equity Hold'Em." The game is played with two to nine players and by default all players use equity play. Player A buys in for $100 and players B-I all buy in for $200. Player A posts the small blind of $2 and Player B posts the big blind of $4. Player I has the dealer button. Two cards are dealt face down to all nine players. Players C-I all fold. Player A who was dealt AsAc raises to $20. Player B who was dealt KsKc raises to $40. Player A moves all-in and player B calls. The pot now contains $200. The house collects a rake of $3 so the pot now contains $197. Since player A is all-in and no more betting is possible the pot is awarded based on the current equity. By calculation we find that player A's equity is 82.6% and player B's equity is 17.4%, so player A is awarded $162.72 and Player B is awarded $34.28.

EXAMPLE 2

This hand starts exactly as in example 1 except only players C-H fold, while player I who was dealt QsQc on the button raises to $20. Player A who was dealt AsAc raises to $40. Player B who was dealt KsKc raises to $100. Players A and I both call. The pot now contains $300 and the house collects a rake of $3 leaving $297. Since player A is all-in but more betting is possible the game proceeds. Player B and player I both still have $100 left to bet with. The flop of 7h6d2s is dealt. Player B bets $100 all-in and player I calls. Since player A is all-in, all further betting is in a side pot between players B and I which now contains $200. Since no more betting is possible the pot is awarded by equity rules. In this case player A's equity is 82.9%, player B's equity is 8.8% and player I's equity is 8.3%. Therefore, player A is awarded 82.9% of the main pot which is equal to $246.21. Player B is awarded 8.8% or $21.67 and player I is awarded 8.3% or $24.65. In addition, player B's equity from the side pot is 91.3% and player I's equity is 8.7% for an additional payout of $182.60 and $17.40 respectively.

EXAMPLE 3

This hand starts exactly as in example 2, however after the flop is dealt, players B and I both check. The turn card is the 7s. Both players check. The river card is the 9d, and again, both players check. Player A is awarded the entire pot of $297 since the conditions for the equity option were never satisfied during the hand, i.e., no more betting possible and more cards to be dealt.

As shown in FIG. 3 the computer system 10 is able to maintain a constant calculated value of the equity in each of the hands in the game because all cards are scanned by card dispenser 30 where optical recognition is used to recognize which card is being dispensed and then dealt to the players 8 or to the community. As stated previously when all the players 8 elect equity play, the pot is distributed in accordance with equity values of the hands in play. When not all players 8 have elected equity play and the best hand is held by a player 8 who has not elected equity play, the pot may be distributed to the best hand or according to equity, depending on the rule by which the game is being played. Another option rule might be to select between best hand and equity distribution depending on how many hands are still standing of the elected or non-elected equity play. These and other rule options are possible. Further, to the election of equity play, the players 8 may elect to allow the electing of equity play only prior to the start of card play, only during card play, or only at certain times during the game, such as just after the flop has been dealt. Therefore, the rule for electing equity play may call for the restricting of when a player 8 is allowed to elect or cancel equity play. In general, the term "elect" is used herein to imply the selection of the initiation of equity play and also the cancellation of equity play. Also, the rule for electing equity play may provide for a limited number of such elections, that is, a limitation on frequency, as for example, only once to initiate equity play, or alternately only one initiation and one cancellation during each game. Another possible option is to allow equity play election based on a condition, such as being, based on a player's equity position. For example, the condition might be to initiate equity play at the start of each game and cancel the equity option if the player's equity becomes greater than the average equity of all the active players 8.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. In a computer system having equipment including a data processor, a memory device, a software instruction set, a central display and a plurality of player modules, the player modules each having a module display enabled for displaying data from the data processor, and a selection device enabled for sending data to the data processor, the equipment adapted for presenting and controlling a wagering card game having a method of card play controlled by the software instruction set, comprising the steps of:

a) presenting playing cards, as signals from the data processor to each said module display, thereby establishing a card hand of each player of a plurality of players of the wagering card game;

b) sending betting signals from the selection devices to the data processor thereby completing at least one betting round of wagering;

c) establishing a necessary condition for equity play in the wagering card game, the necessary condition requiring that no further betting is possible and yet at least one more round of card dealing remains to be dealt, according to rules of the wagering card game;

d) calculating an equity of each said card hand of each active said player;

e) calculating a distribution of a pot of the card game in accordance with the calculated equity of each said card hand; and f) displaying, on the central display, the distribution of the pot and a new value of betting chips for each said plurality of players.

2. The method of card play of claim 1 further providing the step of electing equity play by at least one of the players and distributing the pot to the remaining players according to the calculation of equity in the card hands of the remaining players including the player having a best hand.

3. The method of card play of claim 1 further providing the step of electing equity play by the players both prior to and during card play.

4. The method of card play of claim 3 further providing the step of partially restricting the electing of equity play by the players.

5. The method of card play of claim 4 further providing the step of limiting a frequency of the electing of equity play during a hand.

6. The method of card play of claim 1 further providing the step of electing equity play using a condition.

7. The method of card play of claim 6 wherein the condition is related to the relative value of the equity of the player using the condition.

8. The method of card play of claim 1 further providing the step of awarding the entire pot to the best hand when at least one active player does not elect equity play.

9. In a computer system having equipment including a data processor, a memory device, a software instruction set, and a central display, the equipment adapted for controlling a wagering card game having a method of card play comprising the steps of:

a) presenting playing cards to a plurality of players of the wagering card game, thereby establishing a card hand of each player;

b) completing at least one betting round of wagering;

c) establishing a necessary condition for equity play in the wagering card game, the necessary condition requiring that no further betting is possible and yet at least one more round of card dealing remains to be dealt, according to rules of the wagering card game;

d) calculating an equity of each said card hand of each active said player;

e) calculating a distribution of a pot of the card game in accordance with the calculated equity of each said card hand; and f) distributing the pot to the active players according to said calculated equity.

10. The method of card play of claim 9 further providing the step of electing equity play by at least one of the players and distributing the pot to the remaining players according to the calculation of equity in the card hands of the remaining players including the player having a best hand.

11. The method of card play of claim 9 further providing the step of electing equity play by the players both prior to and during card play.

12. The method of card play of claim 11 further providing the step of partially restricting the electing of equity play by the players.

13. The method of card play of claim 12 further providing the step of limiting a frequency of the electing of equity play during a hand.

14. The method of card play of claim 9 further providing the step of electing equity play using a condition.

15. The method of card play of claim 14 wherein the condition is related to the relative value of the equity of the player using the condition.

16. The method of card play of claim 9 further providing the step of awarding the entire pot to the best hand when at least one active player does not elect equity play.

* * * * *